United States Patent [19]

Hutchins et al.

[11] Patent Number: 5,045,047

[45] Date of Patent: Sep. 3, 1991

[54] AUTOMATED CENTRIFUGE

[75] Inventors: Burleigh M. Hutchins, Hopedale; Raymond R. Dunlap, Uxbridge; Louis Abrahams, Worcester; Susan M. Amato, Milford, all of Mass.

[73] Assignee: Zymark Corporation, Hopkinton, Mass.

[21] Appl. No.: 380,965

[22] Filed: Jul. 17, 1989

[51] Int. Cl.[5] ..... B04B 5/02

[52] U.S. Cl. ..... 494/17; 494/19; 494/20

[58] Field of Search ..... 494/16-21, 494/31-34, 37, 44, 47, 48, 66, 84, 85, 7; 436/45, 177; 210/360.1, 378, 656, 144, 267, 512.1, 787

[56] References Cited

U.S. PATENT DOCUMENTS

| | | | |
|---|---|---|---|
| 2,507,309 | 5/1950 | Larsson | 494/16 |
| 3,199,775 | 8/1965 | Drucker | 494/37 X |
| 3,401,876 | 9/1968 | Lucas | 494/7 X |
| 3,747,842 | 7/1973 | Grubb et al. | 494/16 |
| 3,864,089 | 2/1975 | Tiffany et al. | 494/17 X |
| 3,944,133 | 3/1976 | Kessell et al. | 494/31 X |
| 4,091,989 | 5/1978 | Schlutz | 494/37 X |
| 4,190,530 | 2/1980 | Forsythe, Jr. et al. | 210/787 X |

*Primary Examiner*—Harvey C. Hornsby
*Assistant Examiner*—Charles E. Cooley
*Attorney, Agent, or Firm*—John E. Toupal; Harold G. Jarcho

[57] ABSTRACT

A centrifuge apparatus including a rotor; a drive coupled to the rotor; an inner ring adapted to pivotally support an annular array of inner containers having open upper ends; an inner coupling coupled between the rotor and the inner ring so as to cause rotation thereof and resultant centrifugal force induced inward pivotal movement of the upper ends into the centrifuge positions; an outer ring adapted to pivotally support an annular array of outer containers having open upper ends and displaced outwardly from the inner array in a direction transverse to the rotational axis of the rotor means; an outer coupling coupled between the rotor and the outer ring so as to cause rotation thereof and resultant centrifugal force induced inward pivotal movement of the upper ends of the outer containers into centrifuge positions; and an inner orientation mechanism for preventing movement of the upper ends of the inner containers into their centrifuge positions.

26 Claims, 7 Drawing Sheets

AUTOMATED CENTRIFUGE

BACKGROUND OF THE INVENTION

This invention relates generally to an automated centrifuge and, more specifically, to a centrifuge with inner and outer concentric rings of tubes which can be automatically controlled in repeated centrifuging, decanting, pouring, washing and mixing operations.

Centrifuges having inner and outer rings or banks of tubes are known in the art. See U.S. Pat. No. 4,190,530; Forsythe et al. Also, the use of a static resilient member to frictionally engage tubes during a portion of their rotation in a centrifuge to enhance the mixing action is known. See U.S. Pat. No. 3,401,876, Lucas. However, prior centrifuge systems have failed to provide the automatic operation required for many relatively complicated laboratory applications.

One typical centrifuging procedure which requires multiple steps is the DNA plasmid "mini-prep". Plasmids are short, circular rings of DNA that reside in bacteria such as *E. coli.* They are used frequently as tools in genetic engineering. By removing the plasmid from the bacterium, cleaving the ring at a certain point, inserting a different section of DNA, re-joining the ring and inserting the ring into another, "host", bacterium, the bacterium will "express" the genetic information contained in the inserted DNA section. Most often the presence of the new length of DNA will induce the bacterium to produce a compound or drug which is difficult to manufacture by conventional means.

The above procedure has usually been done in batches of thousands of bacteria and comprises the following steps:

1. The bacteria is grown overnight in Luria Broth in a tube and then centrifuged two minutes at 10,000 RPM.
2. The centrifuge is stopped, supernatant is decanted to waste.
3. The cells are resuspended by vortex action.
4. Lysis buffer is added to break open cells and then mixed.
5. Neutralization buffer is added and then mixed.
6. The tubes sit for 1–10 minutes.
7. The tubes are centrifuged for 10 minutes at 15,000 RPM.
8. The centrifuge is stopped and the supernatant decanted into a clean tube.
9. Alcohol is added to the supernatant to precipitate the plasmids and then mixed.
10. This mixture is then centrifuged for 3 minutes at 13,000 RPM.
11. The centrifuge is stopped and the supernatant decanted to waste.
12. The pellet containing plasmids is washed and then mixed to re-suspend.

Procedures of the above type are labor intensive, requiring dedicated operator attention and care to operate the centrifuge, pipette liquid into the tubes and decant from one tube into another. Operator skill varies from person to person, especially in the decanting operation, so reproducibility of the procedure varies accordingly. Efficient, costeffective automation of such procedures could insure reproducibility and free the operator for more productive tasks.

SUMMARY OF THE INVENTION

The invention is a centrifuge apparatus including a rotor; a drive coupled to the rotor; an inner ring adapted to pivotally support an annular array of inner containers having open upper ends; an inner coupling coupled between the rotor and the inner ring so as to cause rotation thereof and resultant centrifugal force induced inward pivotal movement of the upper ends into centrifuge positions; an outer ring adapted to pivotally support an annular array of outer containers having open upper ends and displaced outwardly from the inner array in a direction transverse to the rotational axis of the rotor means; an outer coupling coupled between the rotor and the outer ring so as to cause rotation thereof and resultant centrifugal force induced inward pivotal movement of the upper ends of the outer containers into centrifuge positions; and an inner orientation mechanism for preventing movement of the upper ends of the inner containers into their centrifuge positions. By preventing movement of the inner containers to their centrifuge positions, the inner orientation mechanism can induce automatic transfer of fluid between the inner and outer containers.

According to one feature of the invention, the inner and outer coupling mechanisms are adapted to selectively produce between the inner and outer rings and with respect to the rotational axis of the rotor relative angular displacement between a first condition in which the inner containers are radially aligned with the outer containers and a second condition in which the inner containers are radially misaligned with the outer containers. The aligned condition permits fluid transfer between the inner and outer containers while the misaligned condition permits emptying of the inner containers.

According to other features of the invention, the apparatus includes an inner dispensing assembly having an inner outlet port positioned for alignment with each of the open ends of the inner containers, and an outer dispensing assembly having an outer outlet port positioned for alignment with each of the open ends of the outer containers; and the inner and outer couplings are adapted to selectively produce misalignment between the open ends of the inner containers and the inner outlet ports, and misalignment between the open ends of the outer containers and the outer outlet ports. With the outlet ports and open container ends aligned, fluid can be dispensed into the inner and outer containers and with the ports and containers misaligned, the dispensing assemblies can be purged to waste.

According to another feature, the invention includes an outer orientation mechanism for preventing said movement of the upper ends of the outer containers into centrifuge positions. By preventing movement of the outer containers into their centrifuge positions, the outer orientation means can induce decanting of the outer containers.

According to yet another feature of the invention, the apparatus includes an inner mixing means for selectively inducing continuous rotation of each inner container about its axis in .response to rotation of the inner ring, and an outer mixing means for selectively inducing continuous rotation of each outer container about its axis in response to rotation of the outer ring. Automatic continuous independent rotation of the containers while they are being centrifuged significantly enhances mixing of their fluid contents.

According to yet other features of the invention, the inner and outer dispensing assemblies are supported by the rotor and keyed for rotation therewith; each dispensing assembly comprises a plurality of arms extending radially from the rotor and each defining a flow passage terminating at one of the outlets; and the outer arms are disposed above the inner arms and extend radially outwardly therefrom. Centrifugal force induced feeding of the inner and outer containers is simplified by this structural arrangement.

According to a further feature of the invention, the inner mixing means comprises an inner band selectively movable between an active position engaging all of the inner containers and an inactive position disengages therefrom, and the outer mixing means comprises an outer band selectively movable between an active position engaging all of the outer containers and an inactive position disengaged therefrom. In response to engagement between the bands and the containers, continuous rotation thereof is produced.

According to additional features of the invention, the inner and outer orientation mechanism each comprises an annular actuator adapted to engage the bottoms of and selectively move the inner and outer containers into decant positions with their open ends shifted outwardly and thereby produce centrifugal force induced decanting of their fluid content in response to rotation of said rotor means.

According to a featured embodiment of the invention, the inner and outer bands and actuators comprise a pair of unitary vertically movable assemblies, wherein the inner actuator is mounted below and radially inwardly of the inner band, and the outer actuator is mounted below and radially inwardly of the outer band. The desired container mixing and orientation functions are efficiently provided by this structural arrangement.

According to still further features of the invention, the inner and outer rings are circular, the rotor is concentrically disposed within the rings, and the inner and outer rings are adapted to position the upper ends of the inner containers below the upper ends of the outer containers. This structural arrangement facilitates the transfer of fluid between the inner and outer containers.

DESCRIPTION OF THE DRAWINGS

These and other objects and features of the invention will become more apparent upon a perusal of the following description taken in conjunction, with the accompanying drawings wherein.

DESCRIPTION OF THE PREFERRED EMBODIMENT

Figure 1:
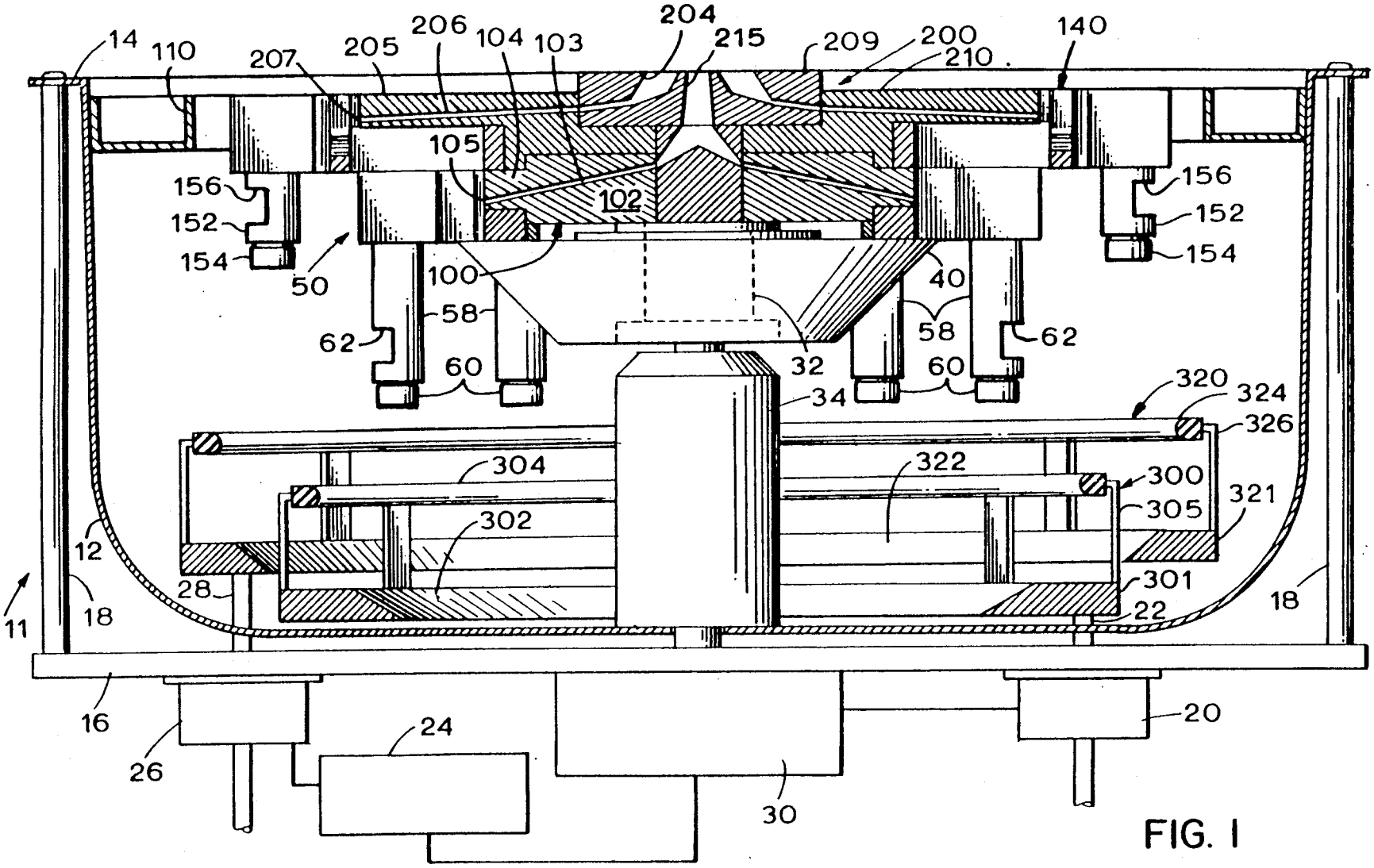
FIG. 1 is a front view of a centrifuge embodying the invention.

Referring to FIG. 1, a centrifuge 11 includes a bowl 12 having an upper lip 14. The bowl 12 is supported above a plate 16 by posts 18 that are secured to the lip 14. A first motor 20 is secured to the plate 16 and includes a drive shaft 22 which extends into the bowl 12. When actuated by the motor 20, the shaft 22 raises or lowers an inner mixing-orientation mechanism 300. A second motor 26 is secured to the plate 16 and includes a shaft 28 which extends into the bowl 12. When actuated by the motor 26, the shaft 28 raises or lowers an outer mixing-orientation mechanism 320. Although single actuating shafts 22 and 28 are shown in the interest of clarity, it will be understood that plural, symmetrically disposed activating shafts are preferred for each of the mechanisms 300 and 320. A third motor 30 is secured to the plate 16 and includes a shaft 32 which drives the rotor 34. Controlling the operation of the motors 20, 26 and 30 is a circuit 24.

Figure 5:
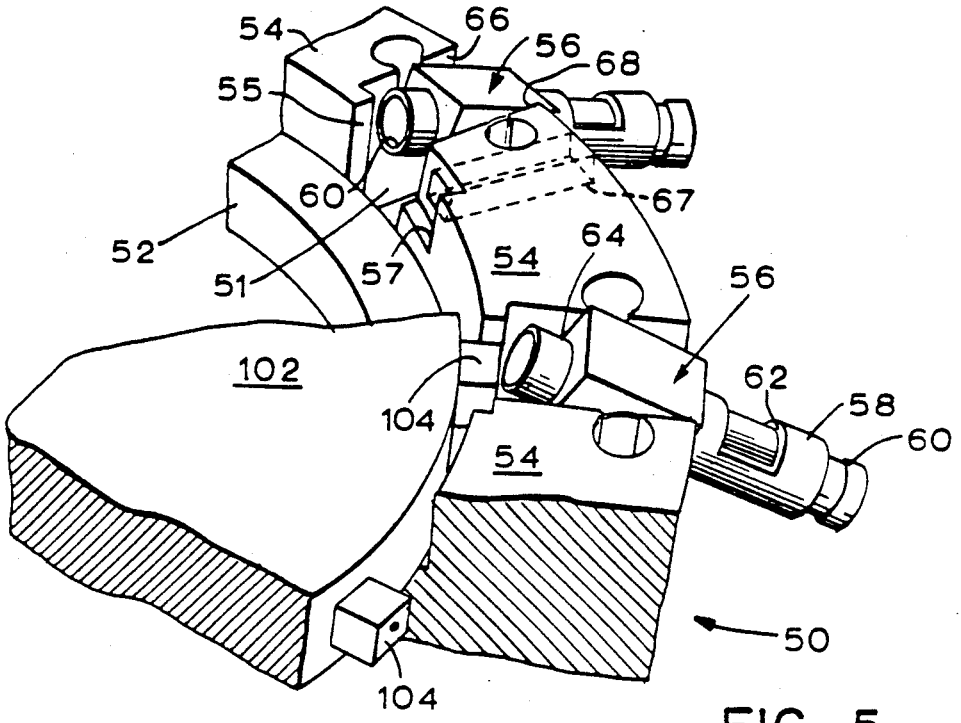
FIG. 5 is a partial perspective view of the inner ring.
Figure 6:
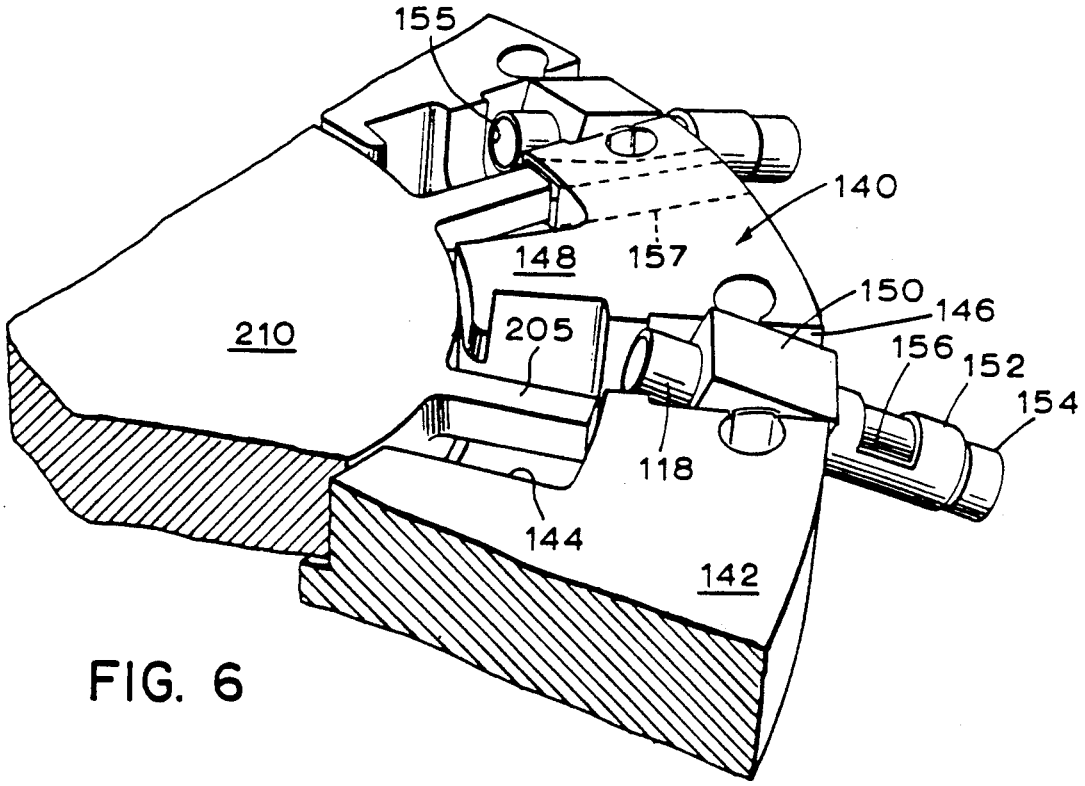
FIG. 6 is a partial perspective view of the outer ring.
Figure 7:
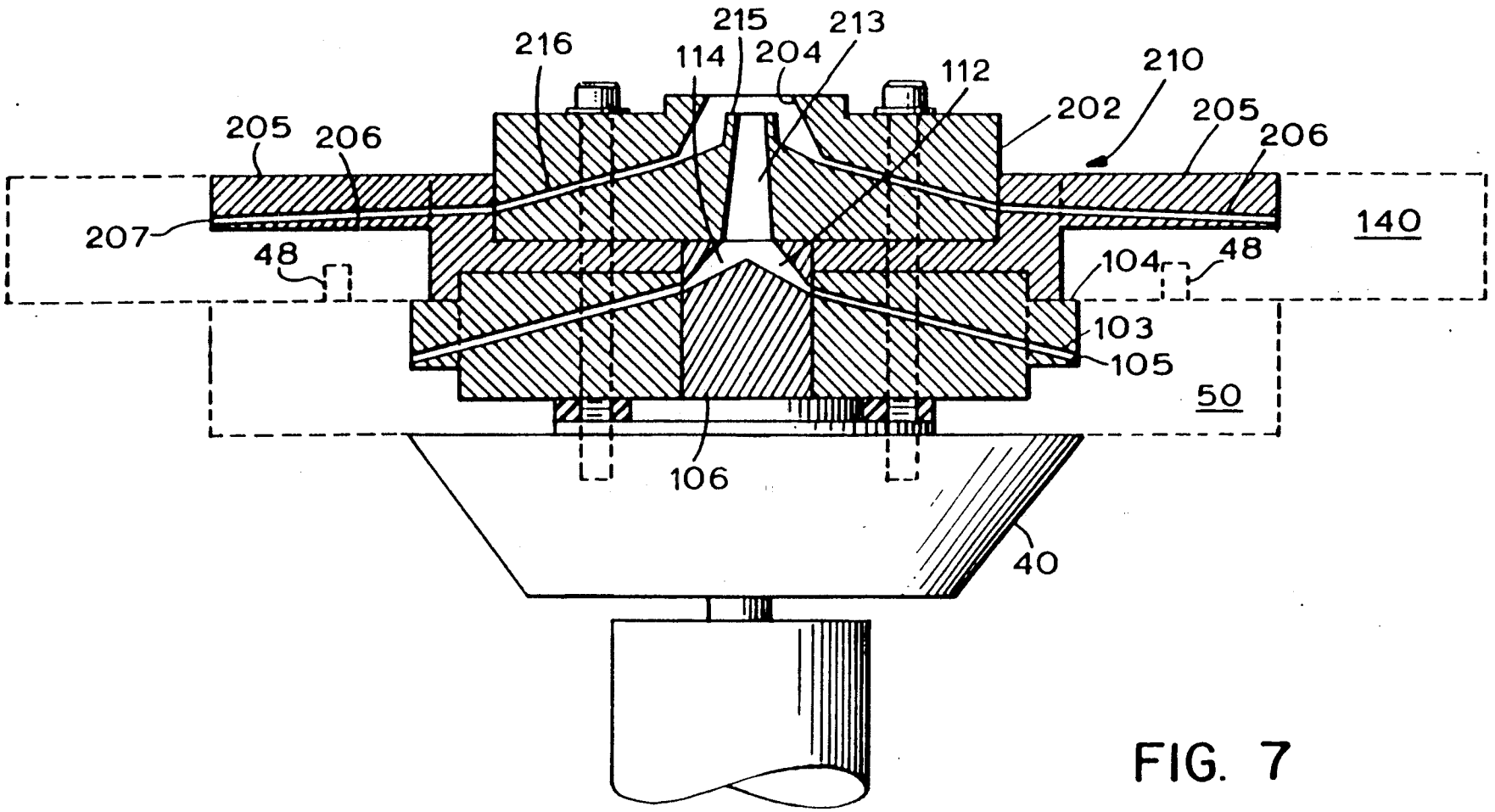
FIG. 7 is a front sectional view of a manifold assembly.

Fixed to the shaft 32 is a platform 40 that slidably carries an inner ring 50 which retains a circular array of inner tubes 64 having open upper ends 60 (FIG. 5). An inner dispensing assembly 100 is fixed to the platform 40 and includes a central hub portion 102 and radially extending inner dispensing arms 104. Passing through each arm 104 is a passage 103 that terminates at an inner outlet port 105. Slidably mounted on the inner ring 50 is an outer ring 140 which retains a circular array of outer container tubes 118 having open upper ends 155 (FIG. 6). The outer tubes 118 are disposed radially outwardly and above the inner tubes 64. Both inner and outer tube arrays are concentrically positioned with respect to the centrally located rotor shaft 32. Mounted in the bowl 12 is an annular trough 110 for receiving waste decanted from the tubes 64 and 118.

Secured to the inner assembly 100 is an outer dispensing assembly 200 which includes a central hub portion 210 and radially extending outer arms 205. Passing through each arm 205 and the hub portion 210 is a passage 206 that terminates at an outer outlet port 207. An outer manifold 209 is retained by the hub portion 210 and defines an inner inlet port 215 communicating through a central channel 213 with the inner passages 103 via passages 112, 114 in an inner manifold 106 retained by the hub 102. The outer manifold 202 also defines an outer inlet port 204 communicating with the outer passages 206 via passages 216.

The inner mixing-orientation mechanism 300 is an integral unit including an upper circular band 304 and a lower circular ring 301 joined by vertical struts 305. Formed on the lower ring 301 is a beveled actuator surface 302 arranged to engage holders of the inner tubes 64 upon movement of the inner mechanism 300 into an upper position. The upper mixing band 304, preferably made from a resilient material such as rubber, is arranged to engage the outer surfaces of the inner tubes 64 upon upward movement of the assembly 300 into an intermediate position. Similarly, the outer mixing-orientation mechanism 320 is an integral unit including an upper circular band 324 and a lower circular ring 321 joined by vertical struts 326. Formed on the lower ring 321 is a beveled actuator surface 322 arranged to engage holders of the outer tubes 118 upon movement of the outer assembly 320 into an upper position. The upper mixing band 324, preferably made from a resilient material such as rubber, is arranged to engage the outer surfaces of the outer tubes 118 upon upward movement of the assembly 320 into an intermediate position.

The outer dispensing assembly 200, the inner dispensing assembly 100, and the platform 40 are secured together by bolts (not shown) and as a unit are keyed for rotation to the rotor shaft 32. Coupling the shaft 32 to the inner ring 50 is an inner coupling consisting of the inner arms 104 and opposing shoulder portions 55, 57 of the inner ring 50 shown in FIG. 5. Each pair of the shoulders 55, 57 is positioned to alternately engage one of the inner arms 104 and thereby establish a limited given degree of relative angular motion between the inner dispensing mechanism 100 and the inner ring 50. With the rotor shaft 32 turning clockwise, the inner arms 104 engage the shoulders 57 to drive the inner ring 50 also in a clockwise direction. Conversely, with the shaft 32 turning counterclockwise, the inner arms 104 engage the shoulders 55 to drive the inner ring also counterclockwise. Coupling the outer ring 140 to the inner ring 50 is an outer coupling consisting of a pair of pins 48 on the upper surface of the inner ring 50 and a receiving pair of slots 159 on the bottom surface of the outer ring 140. The pins 48 alternately engage opposite ends of the slots 159 and thereby limit relative angular motion between the inner ring 50 and the outer ring 140. With the shaft 32 turning clockwise, the pins 48 engage first ends of the slots 159 to drive the outer ring 140 clockwise and, with the shaft turning counterclockwise, the pins engage opposite ends of the slots 159 to drive the outer ring counterclockwise. Thus, the inner and outer couplings establish between the shaft 32 and the outer ring 140 a predetermined degree of relative angular motion equal to the sum of the given relative motion provided between the shaft 32 and the inner ring 50 by the inner coupling and the relative angular motion provided between the outer ring 140 and the inner ring 50 by the outer coupling.

Figure 2:
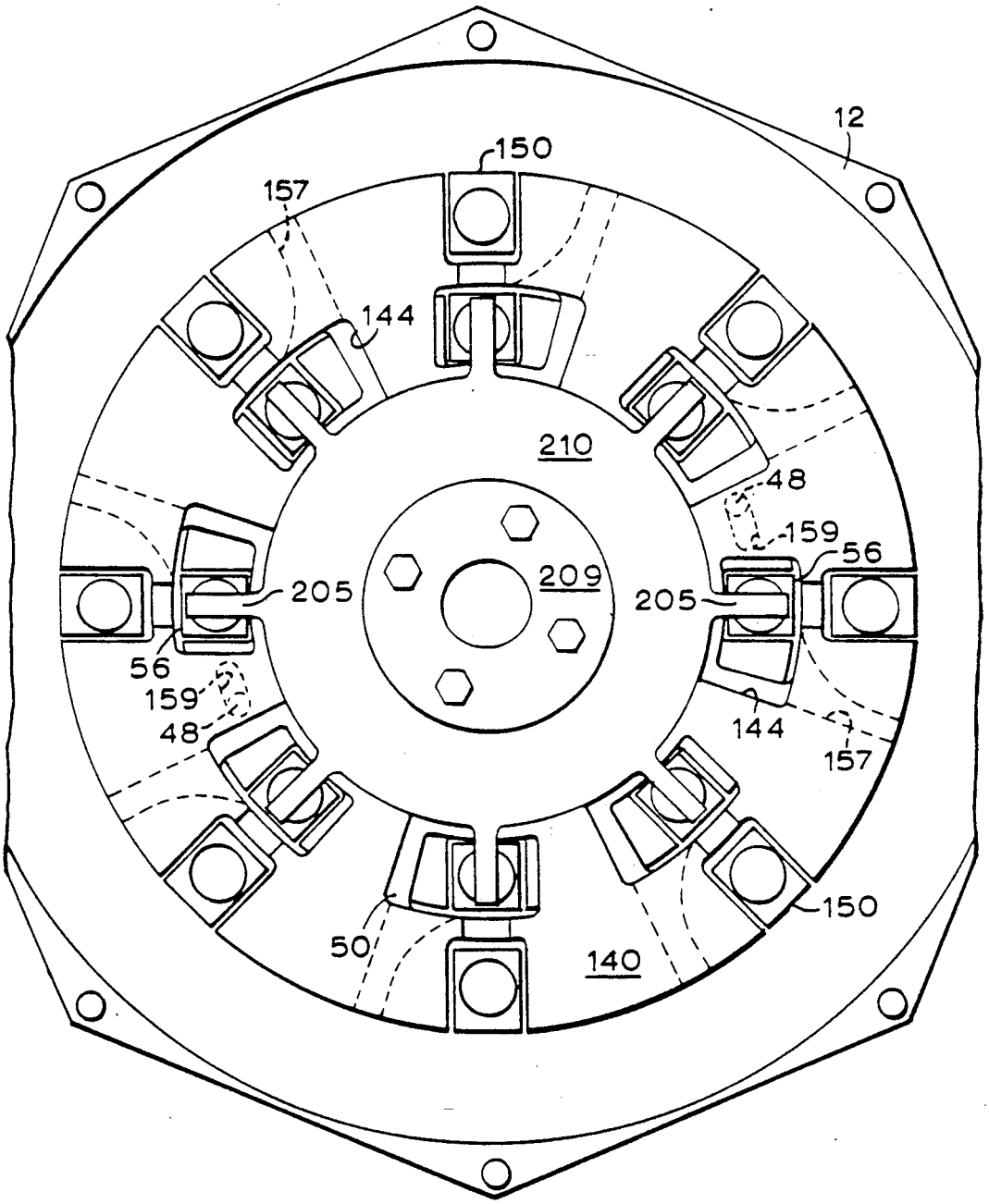
FIG. 2 is a top view of FIG. 1 with container tubes in first positions.
Figure 3:
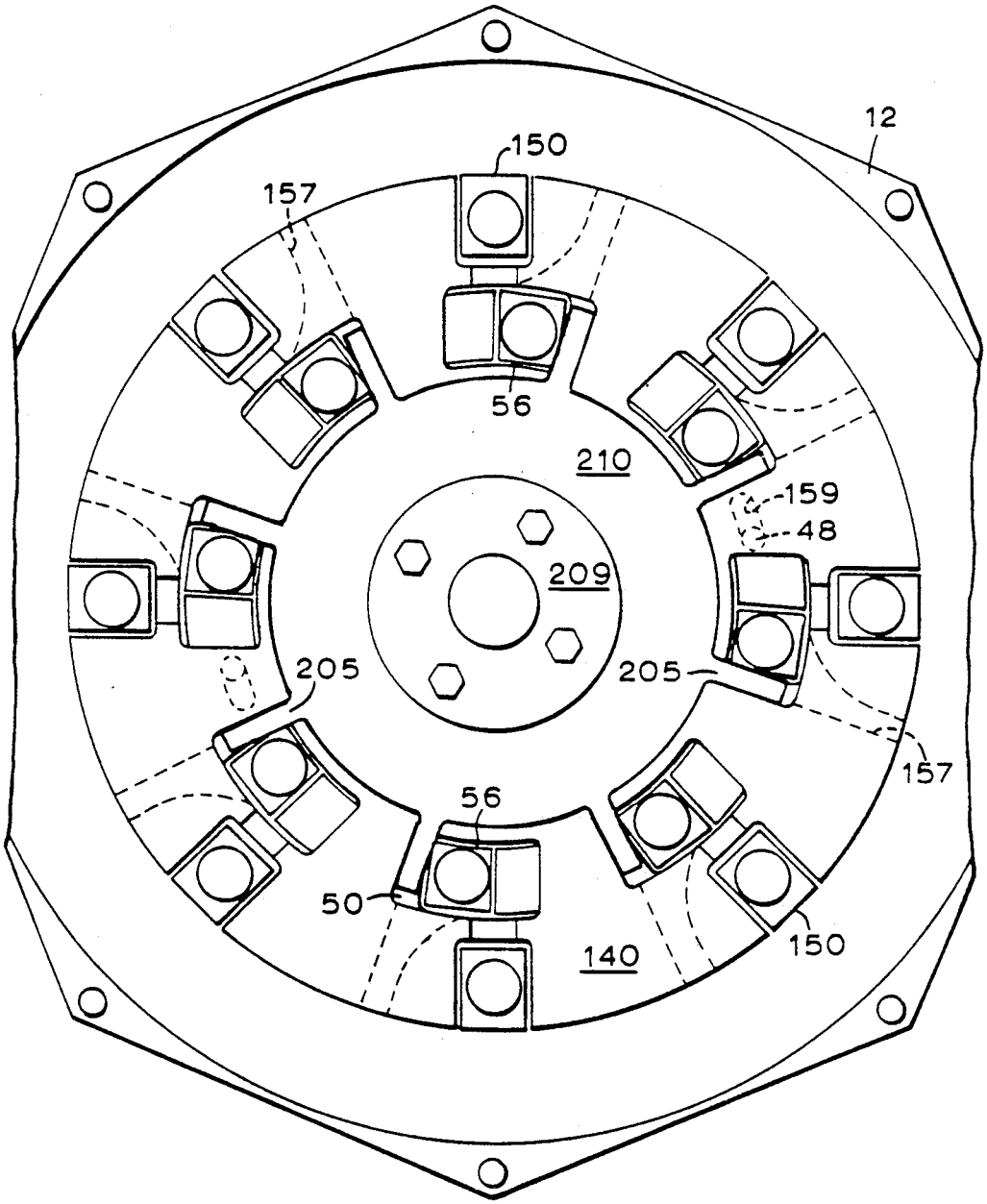
FIG. 3 is a top view of FIG. 1 with the container tubes in offset positions.

The relative angular positions of the inner and outer rings 50, 140 for opposite senses of shaft rotation are illustrated in FIGS. 2 and 3. With the shaft 32 turning counterclockwise, the inner tubes 64 are in transfer positions radially aligned with the outer tubes 118, the inner dispensing arms 104 and inner outlets 105 are in feed positions radially aligned with the inner tubes 64, and the outer dispensing arms 205 and outer outlets 207 are in feed positions radially aligned with the outer tubes 156 as shown in FIG. 2. Conversely, with the shaft 32 turning clockwise, the inner tubes 64 are in decanting positions radially misaligned with the outer tubes 118, but radially aligned with discharge passages 157 in the outer ring 140. The inner arms 104 and inner outlets 105 are in purge positions radially misaligned with the inner tubes 64 but radially aligned with discharge passages 67 (FIG. 5) in the inner ring 50, and the outer arms 205 and outer outlets 207 are in purge positions radially misaligned with the outer tubes 118 but radially aligned with the discharge passages 157 as shown in FIG. 3.

Figure 4:
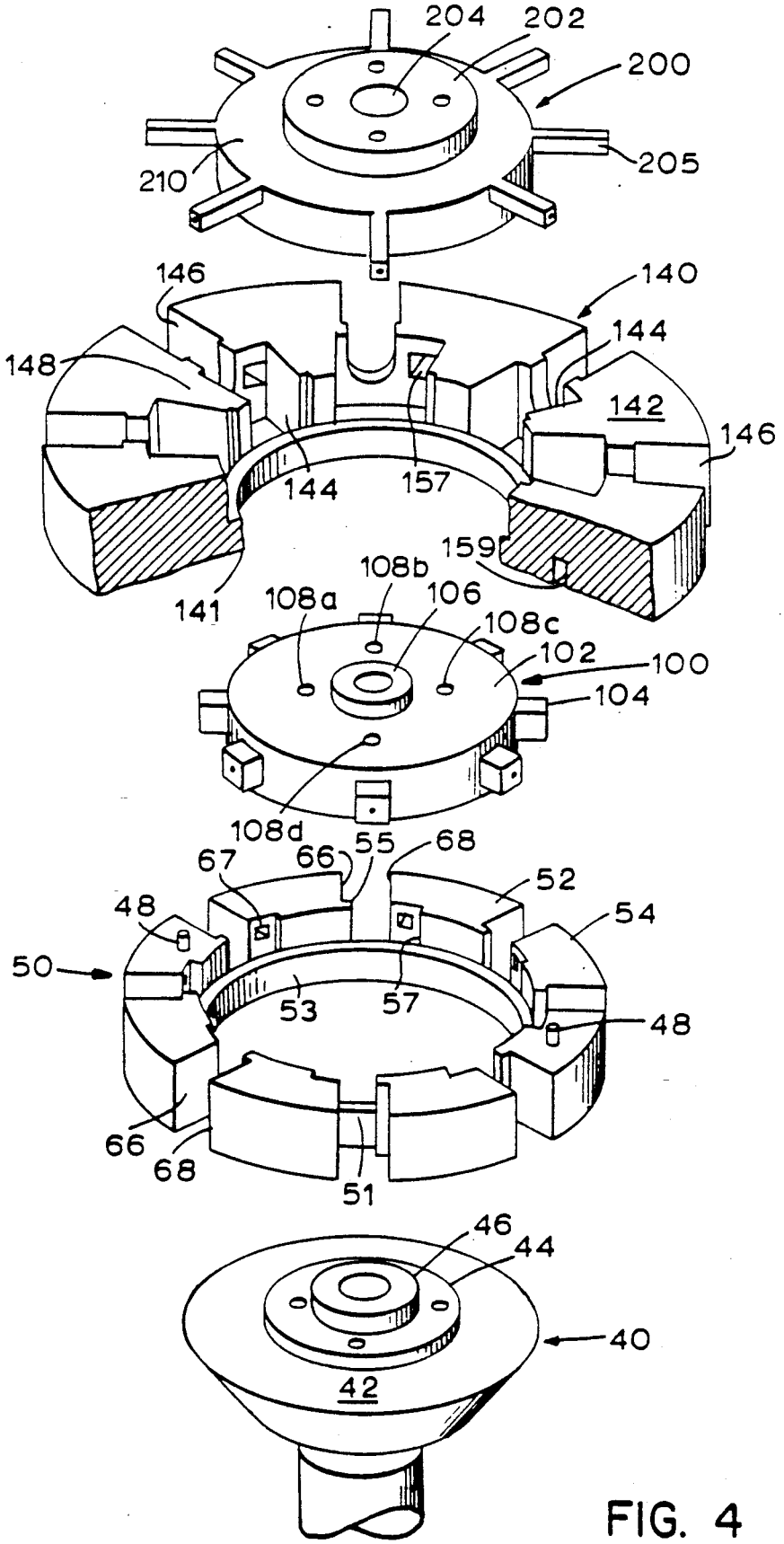
FIG. 4 is an exploded perspective view of a rotor, an inner ring, an inner dispensing assembly, an outer ring, and an outer dispensing assembly.

Referring to FIG. 4, the platform 40 is keyed to the shaft 32 and has a surface 42 for slidably supporting the inner ring 50 and shoulder and head portions 44, 46 fixed to the inner dispensing assembly 100. The inner ring 50 has circumferentially distributed sections 52 separated by openings 51 in which the inner tubes 64 are received. Remaining structure of the inner ring 50 will be described below with reference to FIG. 5. Joining the sections 52 is an internal circular flange portion 53.

The inner dispensing assembly 100 includes the dispensing arms 104 which project from a manifold 102. Formed in the manifold are bolt holes 108*a–d* and a central shoulder portion 106 is received by the outer dispensing assembly 200. The outer ring 140 has an inwardly extending, annular flange 141 that supports the outer dispensing assembly 200. Remaining structure of the outer ring 140 will be described below in reference to FIG. 6.

Referring to FIGS. 4 and 5, each opening 51 in the inner ring 50 retains a trunnion 56. Secured to each trunnion 56 is a sleeve 58 which retains a roller bearing 60 at its lower end. An open window 62 is formed in the outer lower end of each sleeve 58. The inner tubes 64 are received in the sleeves with their open upper ends (mouths) extending beyond the upper surface of the inner ring 50. Supporting each trunnion 56 are facing walls 66 and 68 of the adjacent wedge-shaped sections 54. An inner edge of the wall 66 includes a lip 55 and an inner edge of the wall 68 is characterized by a recess 57. The motion of the dispensing arms 104 (a single arm shown in fragmentary perspective in FIG. 5) is limited by engagement with the lips 55 and recesses 57. When a dispensing arm 104 abuts the lip 55, the dispensing arm is in fluid flow alignment with a tube 64. Conversely, when the dispensing arms 104 engage the recess 57, the open mouth of the tubes 64 may be accessed such as for decanting.

Referring to FIGS. 4 and 6, the outer ring 140 comprises circumferentially distributed pie-shaped sections 142. Defined between outer portions of the adjacent sections 142 are openings 146. Also defined by inner portions 148 of the sections 142 and extending transversely from the openings 146 are recesses 144 that accommodate the outer dispensing arms 205. Pinned to opposed surfaces of the adjacent sections 142 are trunnions 150 which support sleeves 152 extending downwardly therefrom. The bottom ends of the sleeves 152 having roller bearings 154 thereon and the outside lower portion of the sleeves 152 are characterized by open windows 156. When the outer tubes 118 are received in the sleeves 152, their open upper ends (mouths) extend beyond the upper surface of the outer ring 140. A flange 141 is formed integrally with the inwardly facing surfaces of the sections 148 and the recesses 144 defined thereby are shown most clearly in FIG. 4. These recesses 144 allow for liquids to be transferred between the tubes of the inner and outer rings 50, 140. When the dispensing arms 205 abut first sides of the recesses 144, they are in fluid flow communication with the outer tubes 118. Conversely, with the mechanism 200 moved such that the dispensing arms 205 abut opposite sides of the recesses 144, the arms 205 are out of alignment and the tubes 118 so as to be available for other operations such as decanting, etc.

Figure 8:
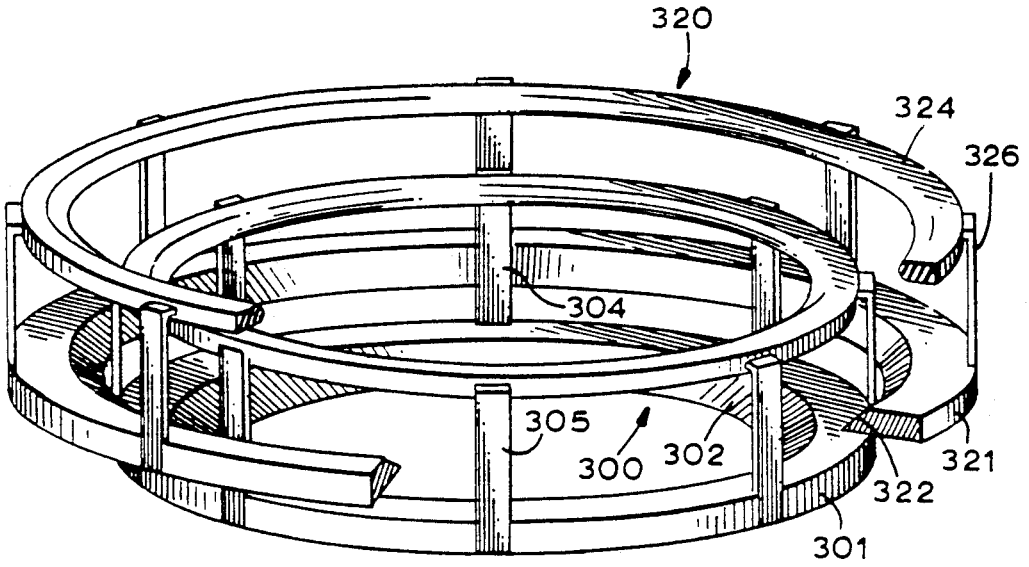
FIG. 8 is a perspective view of mixing and decanting assemblies.
Figure 9:
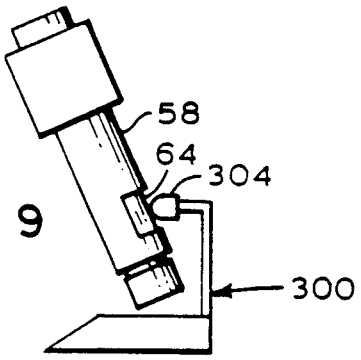
FIG. 9 is a schematic of a tube in a mixing mode.

Referring to FIG. 8, the inner and outer mixing-orientation assemblies 300 and 320 are shown in greater detail. The inner assembly 300 comprises the mixing band 304 spaced above and secured by struts 305 to the orientation ring 301. The inner cam surface 302 of the ring 301 slopes downwardly and inwardly as shown. When the inner assembly 300 is raised from a lower inactive position to an intermediate mixing position, the band 304 projects through the open windows 62 of the sleeves 58 to engage the inner tubes 64 that are being revolved by the inner ring 50 (FIG. 9). This engagement between the band 304 and the surfaces of the inner tubes 64 causes them to rotate individually on their own axes. When the inner assembly 300 is raised to an upper position, the sloped cam surface 302 engages the roller bearings 60 of the sleeves 58 to move the tubes 64 into decanting position shown in FIG. 10. This engagement prevents movement of tubes 64 into centrifuge positions and maintains the mouths of the tubes 64 facing outwardly as shown. Thus, in response to rotation of the shaft 32, centrifugal force will cause liquid within the tubes 64 to be discharged outwardly.

The outer assembly 320 is structurally and functionally similar to the inner assembly 300 and cooperates with the outer ring 140. Included in the outer assembly 320 is a mixing band 324 joined by struts 326 to an outer orientation ring 321 having a sloped cam surface 322. The outer assembly 320 can be moved from an inactive lower position into either an upper position or an intermediate position and thereby control movement of the outer tubes 118 into either mixing or decanting positions in the same manner as described above for the inner assembly 300.

When a centrifuging function is required, the inner and outer mixing-orientation mechanisms 300, 320 are maintained in their lower inactive positions and the shaft 32 is activated to produce high speed rotation of the inner and outer rings 50, 140. Resultant centrifugal force causes the inner and outer sleeves 58, 152 to pivot outwardly into centrifuge positions with the open mouths of the inner and outer tubes 64, 118 facing inwardly as shown in FIGS. 5 and 6. Centrifuging in that manner can occur with the rotor 32 turning in either a clockwise or a counterclockwise direction.

To mix the contents of either the inner or outer tubes 64, 118, the associated mixing-orientation mechanism 300 or 320 is raised to its intermediate position. When the rotor 32 begins to spin, the tubes start to swing outwardly but one of the mixing bands 304 or 324 prevents further travel and frictionally engages the exposed portions of all tubes 64 or 118 causing each tube to rotate about its axis vigorously and continuously mixing its contents as shown in FIG. 9.

Figure 10:
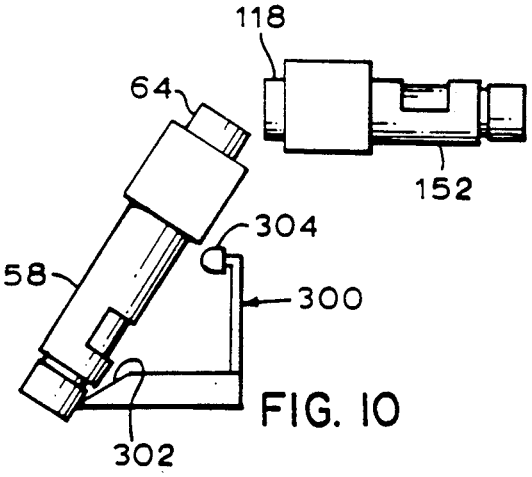
FIG. 10 is a schematic of the tubes in a transfer mode.

When liquid transfer between inner and outer tubes is desired, the orientation assembly 300 is raised to its upper position with the rotor 32 at rest. As the mechanism 300 moves up, the sloping surface 302 engages the bearings at the bottom of each sleeve 58 forcing it inwardly and moving the mouths of the inner tubes 64 outwardly into decanting position as shown in FIG. 10 and preventing subsequent movement into their centrifuge positions. The bearings 60 and 154 allow the sleeves 58, 152 to travel on the sloping surfaces 302 and 322 without binding. With the rotor 32 moving counterclockwise, the inner and outer tubes 64 and 118 are radially aligned as shown in FIG. 2. Thus, the mouths of the outer tubes 118, which are in centrifuge ppsitions, are positioned directly opposite those of the inner tubes 64 which are in decanting positions as shown in FIG. 10. Consequently, liquid from the inner tubes 64 pours into the outer tubes 118 due to centrifugal force.

The outer tubes 118 can be emptied with the rotor turning in either a clockwise or a counterclockwise direction by moving the outer orientation assembly into its upper position. That forces the outer tubes 118 into their decanting positions and centrifugal force causes liquid to be discharged outwardly from the outer ring 140. Emptying of the inner tubes 64, however, requires clockwise rotation of the shaft 32 to produce the misalignment of the inner and outer tubes shown in FIG. 3. In that case, with the inner orientation mechanism 300 in its upper position, the inner tubes will be in decanting position and their liquid contents will be discharged through the discharge passages 157 in the outer ring 140.

For metering fluid into either the inner or outer tubes 64, 118, the shaft 32 is turned counterclockwise to provide the angular position shown in FIG. 2, and the associated orientation mechanism 300 or 320 remains in its lower inactive position. In that case both inner and outer tubes will be forced in centrifuge positions with their mouths radially aligned, respectively, with the inner and outer dispensing arms 104 and 205. Fluid introduced into the inner inlet port 115 will be evenly distributed by centrifugal force into the feed passages 103 for discharge through the inner outlet ports 105 into the mouths of the inner tubes 64. Similarly, fluid introduced in the outer inlet port 204 will be evenly distributed into the feed passages 206 for discharge through the outer outlet ports 207 into the mouths of the outer tubes 118.

Purging of either the inner or outer dispensing assembly 100, 200 requires clockwise rotation of the shaft 32 to provide the angular positions shown in FIG. 3 with the inner dispensing arms 104 aligned with the discharge passages 67 in the inner ring 50 and the outer dispensing arms 205 aligned with the discharge passages 157 in the outer ring 140. Purging fluid introduced into the inner inlet 215 then will flow through the passages 103 for discharge through the outlet ports 105 and the discharge passages 67. Similarly, purging fluid introduced into the outer inlet 204 will flow through the passages 206 for discharge through the outer outlet ports 207 and the discharge passages 157.

Depending on the direction of rotation of the rotor shaft 32 and the elevational positions of the inner and outer orientation mechanisms 300, 320, the apparatus 11 can function in sixteen different operating modes as follows:

Mode 1 in which the rotor 32 turns counterclockwise and the inner and outer assemblies 300, 320 are both in lower inactive positions. In Mode 1, both inner and outer tubes 64, 118 are in centrifuge positions and radially aligned, respectively, with the inner and outer dispensing ports 105, 207. Thus, the inner and outer tubes 64, 118 can be both centrifuged and filled in this mode.

Mode 2 in which the rotor 32 turns counterclockwise, the inner mechanism 300 is in its intermediate position and the outer mechanism 320 is in its lower position. In Mode 2 the outer tubes 118 assume centrifuge positions and the inner tubes 64 engage the inner band 304. Thus, the inner tubes 64 can be mixed and the outer tubes 156 centrifuged in this mode.

Mode 3 in which the rotor 32 turns counterclockwise, the inner mechanism 300 is in its lower position and the outer mechanism 320 is in its intermediate position. In Mode 3, the inner tubes 64 assume centrifuge positions and the outer tubes 118 engage the outer band 324. Thus, the inner tubes 64 can be centrifuged and the outer tubes 118 mixed in this mode.

Mode 4 in which the rotor 32 turns counterclockwise, and both the inner and outer mechanisms 300, 320 are in intermediate positions. In Mode 4, both inner and outer tubes 64, 118 assume mixing positions and their contents are mixed.

Mode 5 in which the rotor 32 turns counterclockwise, the inner mechanism 300 is in its upper position and the outer mechanism 320 is in its lower position. In Mode 5, the inner tubes 64 are in decant positions and the outer tubes 156 assume centrifuge positions. Thus, the liquid contents of the inner tubes 64 can be transferred to the outer tubes 118 in this mode.

Mode 6 in which the rotor 32 turns counterclockwise, the inner mechanism 300 is in its lower position and the outer mechanism 320 is in its upper position. In Mode 6, the inner tubes 64 assume centrifuge positions and the outer tubes 118 are in decant positions. Thus, the inner tubes 64 can be centrifuged and the outer tubes 118 decanted in this mode.

Mode 7 in which the rotor 32 turns counterclockwise, the inner mechanism 300 is in its intermediate position and the outer mechanism 320 is in its upper position. In Mode 7, the inner tubes 64 engage the inner band 304 and the outer tubes 118 are in decant positions. Thus, the inner tubes 64 can be mixed and the outer tubes 118 decanted in this mode.

It should be noted that in each of Modes 2–7, the inner feed ports 105 are radially aligned with the inner tubes 64 and the outer feed ports 207 are aligned with the outer tubes 118. Thus, the inner tubes 64 can be filled from the inner feed ports 105 in Modes 3 and 6 and the outer tubes 118 can be filled from the outer feed ports 207 in Modes 2 and 5.

It should be noted that in each of the following Modes 8–16, the inner feed passages 103 are out of radial alignment with the inner tubes 64 and the outer feed passages 206 are out of radial alignment with the outer tubes 118 and are in radial alignment, respectively, with the discharge passages 67, 157.

Mode 8 in which the rotor 32 turns clockwise and both the inner and outer mechanisms 300, 320 are in their lower positions. In Mode 8, both the inner and outer tubes 64, 118 assume centrifuge positions. Thus, the inner and outer tubes 64, 118 can be centrifuged and the inner and outer dispensing mechanisms 100, 200 can be purged in this mode.

Mode 9 in which the rotor 32 turns clockwise, the inner mechanism 300 is in its lower position and the outer mechanism 320 is in its intermediate position. In Mode 9, the inner tubes 64 assume centrifuge positions and outer tubes 118 engage the outer band 324. Thus, the inner tubes 64 can be centrifuged, the outer tubes 118 mixed and both the inner and the outer feed passages 103, 206 purged in this mode.

Mode 10 in which the rotor 32 turns clockwise, the inner mechanism 300 is in its lower position and the outer mechanism 320 is in its upper position. In Mode 10, the inner tubes 64 assume centrifuge positions and the outer tubes 118 are in decant positions. Thus, the inner tubes 64 can be centrifuged, the outer tubes 118 decanted and both the inner and the outer feed passages 103, 206 purged in this mode.

Mode 11 in which the rotor 32 turns clockwise, the inner mechanism 300 is in its intermediate position and the outer mechanism 320 is in its lower position. In Mode 11, the inner tubes 64 engage the inner band 304 and the outer tubes 118 assume centrifuged positions. Thus, the inner tubes 64 can be mixed, the outer tubes 118 centrifuged and both the inner and the outer feed passages 103, 206 purged in this mode.

Mode 12 in which the rotor 32 turns clockwise and both inner and outer mechanisms 300, 320 are in intermediate positions. In Mode 12 both the inner and outer tubes 64, 118 engage, respectively, the inner and outer bands 304, 324. Thus, both inner and outer tubes 64, 118 can be mixed and both the inner and the outer feed passages 103, 206 purged in this mode.

Mode 13 in which the rotor 32 turns clockwise, the inner mechanism 300 is in its intermediate position and the outer mechanism 320 is in its upper position. In Mode 13, the inner tubes 64 engage the inner band 304 and the outer tubes 118 are in decant positions. Thus, the inner tubes 64 can be mixed, the outer tubes 118 decanted and both the inner and the outer feed passages 103, 206 purged in this mode.

Mode 14 in which the rotor 32 turns clockwise, the inner mechanism 300 is in its upper position and the outer mechanism 320 is in its lower position. In Mode 14, the inner tubes 64 are in decant positions, the outer tubes 118 assume centrifuge positions and the inner tubes 64 are radially aligned with the discharge passages 157. Thus, the inner tubes 64 can be decanted, the outer tubes 118 centrifuged and both the inner and the outer feed passages 103, 206 purged in this mode.

Mode 15 in which the rotor 32 turns clockwise, the inner mechanism 300 is in its upper position and the outer mechanism 320 is in its intermediate position. In Mode 15, the inner tubes 64 are in decant positions, the outer tubes 118 engage the outer band 324 and the inner tubes 64 are radially aligned with the discharge passages 157. Thus, the inner tubes 64 can be decanted, the outer tubes 118 mixed and both the inner and the outer feed passages 103, 206 purged in this mode.

Mode 16 in which the rotor 32 turns clockwise and both the inner and outer mechanisms 300, 320 are in their upper positions. In Mode 16, both inner and outer tubes 64, 118 are in their decant positions and the inner tubes 64 are radially aligned with the discharge passages 157. Thus, both inner and outer tubes 64, 118 can be decanted and both the inner and the outer feed passages 103, 206 purged in this mode.

The operating Modes 1–16 can be employed in any desired combination to satisfy a predetermined laboratory requirement. For example, in the above noted DNA mini-prep prodedure, the following sequence would occur with manual steps indicated in normal type and automatic steps of the apparatus 11 indicated in capital letters.

1. Grow bacteria from colony in Luria Broth overnight, in tubes.

2. Centrifuge 2 min. at 10,000 RPM.

Balance sample tubes and place into sleeves of inner ring;

Place empty tubes in sleeves of outer ring;

MOTOR IS TURNED ON FOR TIMED PERIOD AND ROTOR SPINS COUNTERCLOCKWISE AT 10,000 RPM (MODE 1 OPERATION.)

3. Stop centrifuge, decant supernatant to waste and vortex to resuspend cells.

MOTOR IS TURNED OFF AND ROTOR IS BRAKED:

INNER MECHANISM IS RAISED TO UPPER POSITION: MOTOR IS TURNED ON FOR TIMED PERIOD TO SPIN ROTOR CLOCKWISE; LIQUID IN THE INNER TUBES DECANT TO WASTE (MODE 14);

MOTOR IS TURNED OFF AND ROTOR IS BRAKED:

INNER MECHANISM IS RAISED TO INTERMEDIATE POSITION; MOTOR IS TURNED ON TO SPIN ROTOR CLOCKWISE; INNER TUBE CONTENTS ARE MIXED (MODE 11 OPERATION.)

4. Add lysis buffer, to break open cells, mix.

METERED VOLUME OF LYSIS BUFFER IS ADDED TO INNER TUBES THROUGH INNER FEED PORTS; INNER TUBE CONTENTS ARE MIXED (MODE 2 OPERATION.)

5. Add neutralization buffer, mix.

METERED VOLUME OF NEUTRALIZATION BUFFER IS ADDED TO INNER TUBES

THROUGH INNER FEED PORTS: CONTINUE MODE 2 OPERATION.

6. Let tube sit for 1-10 min.

MOTOR IS TURNED OFF AND ROTOR IS BRAKED:

CENTRIFUGE RESTS FOR TIMED PERIOD.

7. Mix solution.

MOTOR IS TURNED ON FOR TIMED PERIOD TO SPIN ROTOR CLOCKWISE: INNER TUBE CONTENTS ARE MIXED (MODE 11 OPERATION); WASH IS ADDED THROUGH INNER AND OUTER FEED PORTS TO PURGE FEED PASSAGES.

8. Centrifuge 10 min at 15,000 RPM.

INNER MECHANISM IS LOWERED FULLY; MOTOR IS TURNED ON FOR TIMED PERIOD AND ROTOR SPINS COUNTERCLOCKWISE AT 15,000 RPM (MODE 1 OPERATION.)

9. Stop centrifuge and decant supernatant into clean tube.

MOTOR IS TURNED OFF AND ROTOR IS BRAKED;

INNER MECHANISM IS RAISED TO UPPER POSITION; MOTOR IS TURNED ON FOR TIMED PERIOD TO SPIN ROTOR COUNTERCLOCKWISE; LIQUID IN THE INNER TUBES TRANSFERS TO OUTER TUBES (MODE 5);

10. Add alcohol to supernatant to precipitate plasmids, mix.

MOTOR IS TURNED OFF AND ROTOR IS BRAKED:

INNER MECHANISM IS LOWERED FULLY: MOTOR IS TURNED ON FOR TIMED PERIOD TO SPIN ROTOR COUNTERCLOCKWISE; METERED VOLUME OF ALCOHOL IS ADDED TO OUTER TUBES THROUGH OUTER FEED PORTS (MODE 1 OPERATION).

MOTOR IS TURNED OFF AND ROTOR IS BRAKED;

OUTER MECHANISM IS RAISED TO INTERMEDIATE POSITION; MOTOR IS TURNED ON FOR TIMED PERIOD TO SPIN ROTOR COUNTERCLOCKWISE; OUTER TUBE CONTENTS ARE MIXED (MODE 3 OPERATION.)

11. Centrifuge 3 min. at 13,000 RPM.

OUTER MECHANISM IS LOWERED FULLY; MOTOR IS TURNED ON FOR TIMED PERIOD AND ROTOR SPINS COUNTERCLOCKWISE AT 10,000 RPM MODE 1 OPERATION.)

12. Wash pellet containing plasmids and mix contents to resuspend.

METERED VOLUME OF WASH IS ADDED TO OUTER TUBES THROUGH OUTER FEED PORTS; CONTINUE MODE 1 OPERATION;

MOTOR IS TURNED OFF AND ROTOR IS BRAKED;

OUTER MECHANISM IS RAISED TO INTERMEDIATE POSITION; MOTOR IS TURNED ON TO SPIN ROTOR COUNTERCLOCKWISE; MODE 3 OPERATION.)

13. Stop centrifuge and remove tubes.

MOTOR IS TURNED OFF AND ROTOR IS BRAKED.

Obviously, many modifications and variations of the present invention are possible in light of the above teachings. It is to be understood, therefore, that the invention can be practiced otherwise than as specifically described.

What is claimed is:

1. A centrifuge apparatus comprising:

rotor means;

drive means coupled to said rotor means;

inner ring means adapted to pivotally support an annular array of inner containers having open upper ends;

inner coupling means coupling said rotor means to said inner ring means so as to cause rotation thereof and resultant centrifugal force induced pivotal movement of said inner containers into centrifuge positions wherein said open upper ends are directed radially inwardly;

outer ring means adapted to pivotally support an annular array of outer containers having open upper end and displaced outwardly from the inner array in a direction transverse to the rotational axis of said rotor means;

outer coupling means coupling said rotor means to said outer ring means so as to cause rotation thereof and resultant centrifugal force induced pivotal movement of said outer containers into centrifuge positions wherein said open upper ends are directed radially inwardly; and inner orientation means for preventing said movement of said upper ends of said inner containers into said centrifuge positions so as to permit decanting of said inner containers such that fluid is transferred from said inner to said outer containers.

2. An apparatus according to claim 1 wherein said inner and outer coupling means are adapted to selectively produce between said inner and outer ring means relative angular displacement between a first condition in which the inner containers are radially aligned with the outer containers and a second condition in which the inner containers are radially misaligned with the outer containers.

3. An apparatus according to claim 1 or 2 including inner dispensing means comprising an inner outlet port positioned for alignment with each of the open ends of the inner containers, and an outer dispensing means comprising an outer outlet port positioned for alignment with each of the open ends of the outer containers.

4. An apparatus according to claim 3 wherein said inner and outer coupling means are adapted to selectively produce misalignment between the open ends of the inner containers and the inner outlet ports, and misalignment between the open ends of the outer containers and the outer outlet ports.

5. An apparatus according to claim 4 including outer orientation means for preventing said movement of the upper ends of the outer containers into centrifuge positions.

6. An apparatus according to claim 5 including inner mixing means for selectively inducing continuous rotation of each inner container about its axis in response to rotation of said inner ring means, and outer mixing means for selectively inducing rotation of each outer container about its axis in response to rotation of said outer ring means.

7. An apparatus according to claim 6 wherein said inner and outer coupling means are adapted to selectively produce between said rotor means and said inner ring means a given degree of relative angular displacement and between said rotor means and said outer ring means a predetermined degree of relative angular displacement substantially different than said given degree.

8. An apparatus according to claim 7 wherein said predetermined degree is substantially greater than said given degree.

9. An apparatus according to claim 3 wherein said inner and outer dispensing means are supported by said rotor means and keyed for rotation therewith.

10. An apparatus according to claim 9 wherein said inner dispensing means comprises a plurality of inner arms extending radially from said rotor means and each defining a flow passage terminating at one of said inner outlets, and said outer dispensing means comprises a plurality of outer arms extending radially from said rotor means and each defining a flow passage terminating at one of said outer outlets.

11. An apparatus according to claim 10 wherein said outer arms are disposed above said inner arms and extend radially outwardly from said inner arms.

12. An apparatus according to claim 11 wherein said inner and outer coupling means are adapted to selectively produce misalignment between the open ends of the inner containers and the inner outlet ports, and misalignment between the open ends of the outer containers and the outer outlet ports.

13. An apparatus according to claim 6 wherein said inner mixing means comprises an inner band selectively movable between an active position engaging all fo the inner containers and an inactive position disengaged therefrom, and said outer mixing means comprises an outer band selectively movable between an active position engaging all of the outer containers and an inactive position disengaged therefrom.

14. An apparatus according to claim 5 wherein said inner orientation means comprises an inner annular actuator means adapted to selectively move the inner containers into decant positions that produce centrifugal force induced decanting of their fluid content in response to rotation of said rotor means, and said outer orientation means comprises an outer annular actuator means adapted to selectively move the outer containers into decant positions that produce centrifugal force induced decanting of thier fluid content in response to rotation of said rotor means.

15. An apparatus according to claim 14 wherein said inner and outer actuator means are adapted to move into engagement with the bottoms of the inner and outer containers and to produce radially outward movement of the open ends thereof.

16. An apparatus according to claim 15 wherein said inner band and said inner actuator means comprise a unitary vertically movable assembly having said inner actuator means mounted below and radially inwardly of said inner band, and said outer band and said outer actuator comprise a unitary vertically movable assembly having said outer actuator means mounted below and radially inwardly of said outer band.

17. An apparatus according to claim 1 wherein said inner and outer ring means are circular, and said rotor means is concentrically disposed within said ring means.

18. An apparatus according to claim 17 wherein said inner and outer ring means are adapted to position the upper ends of said inner containers below the upper ends of said outer containers.

19. An apparatus according to claim 1 or 2 wherein said inner and outer coupling means are adapted to selectively produce misalignment between the open ends of the inner containers and the inner outlet ports, and misalignment between the open end of the outer containers and the outer outlet ports.

20. An apparatus according to claim 1 or 2 including outer orientation means for preventing said movement of the upper ends of the outer containers into centrifuge positions.

21. An apparatus according to claim 1 or 2 including inner mixing means for selectively inducing continuous rotation of each inner container about its axis in response to rotation of said inner ring means, and outer mixing means for selectively inducing rotation of each outer container about its axis in response to rotation of said outer ring means.

22. A centrifuge apparatus comprising:

rotor means;

drive means coupled to said rotor means;

inner ring means adapted to pivotally support an inner array of inner containers having open upper ends;

inner coupling means coupling said rotor means to said inner ring means so as to cause rotation thereof and resultant centrifugal force induced inward pivotal movement of the upper ends into centrifuge positions wherein said open upper ends are directed radially inwardly;

outer ring means adapted to pivotally support an annular array of outer containers having open upper ends and displaced outwardly from the inner array in a direction transverse to the rotational axis of said rotor means;

outer coupling means coupling said rotor means to said outer ring means so as to cause rotation thereof and resultant centrifugal force induced pivotal movement of said outer containers into centrifuge positions wherein said open upper ends are directed radially inwardly;

inner feed means comprising a first supply manifold having an inner outlet port positioned for alignment with each of the open ends of the inner containers; and outer feed means comprising a second manifold having an outer outlet portion positioned for alignment with each of the open ends of the outer containers and adapted to feed liquid directly into said outer containers independently of said inner containers.

23. An apparatus according to claim 22 wherein aid inner and outer coupling means are adapted to selectively produce misalignment between the open ends of the inner containers and the inner outlet ports, and misalignment between the open ends of the outer containers and the pouter outlet ports.

24. An apparatus according to claim 22 wherein said inner feed means comprises a plurality of inner arms extending radially from said rotor means and each defining a flow passage terminating at one of said inner outlets, and said outer feed means comprises a plurality of outer arms extending radially from said rotor means and each defining a flow passage terminating at one of said outer outlets.

25. An apparatus according to claim 24 wherein said outer arms are disposed above said inner arms and extend radially outwardly from said inner arms.

26. An apparats according to claim 25 wherein said inner and outer coupling means are adapted to selectively produce misalignment between the open ends of the inner containers and the inner outlet ports, and misalignment between the open ends of the outer containers and the outer outlet ports.

* * * * *